US005288022A

United States Patent [19]

Sesser

[11] Patent Number: 5,288,022

[45] Date of Patent: Feb. 22, 1994

[54] PART CIRCLE ROTATOR WITH IMPROVED NOZZLE ASSEMBLY

[75] Inventor: George L. Sesser, Walla Walla, Wash.

[73] Assignee: Nelson Irrigation Corporation, Walla Walla, Wash.

[21] Appl. No.: 72,217

[22] Filed: Jun. 7, 1993

Related U.S. Application Data

[63] Continuation of Ser. No. 789,690, Nov. 8, 1991, abandoned.

[51] Int. Cl.[5] ..... B05B 15/10

[52] U.S. Cl. ..... 239/205; 239/206; 239/222.17

[58] Field of Search ..... 239/203-206, 239/252, 222.11, 222.17

[56] References Cited

U.S. PATENT DOCUMENTS

| | | | |
|---|---|---|---|
| 1,510,930 | 3/1922 | Enell . | |
| 1,821,579 | 9/1931 | Rader . | |
| 2,128,552 | 8/1938 | Rader et al. | 299/61 |
| 3,006,558 | 10/1961 | Jacobs | 239/267 |
| 3,131,867 | 5/1964 | Miller et al. | 239/97 |
| 3,268,173 | 8/1966 | Costa | 239/206 |
| 3,526,363 | 9/1970 | Hauser | 239/206 |
| 3,645,451 | 2/1972 | Hauser | 239/204 |
| 3,854,664 | 12/1974 | Hunter | 239/206 |
| 3,874,588 | 4/1975 | Flynn | 239/206 |
| 4,121,769 | 10/1978 | Drori | 239/222.17 |
| 4,221,333 | 9/1980 | Rodriguez | 239/252 X |
| 4,261,515 | 4/1981 | Rosenberg et al. | 239/453 |
| 4,331,294 | 5/1982 | Gilad | 239/222 |
| 4,353,506 | 10/1982 | Hayes | 239/231 |
| 4,440,345 | 4/1984 | Figwer et al. | 239/252 X |
| 4,471,908 | 9/1984 | Hunter | 239/205 |
| 4,660,766 | 4/1987 | Nelson et al. | 239/222.17 |
| 4,682,732 | 7/1987 | Walto | 239/206 X |
| 4,687,139 | 8/1987 | Lockwood | 239/205 |
| 4,815,662 | 3/1989 | Hunter | 239/222 |
| 4,834,292 | 5/1989 | Dyck | 239/446 |
| 4,842,201 | 6/1989 | Hunter | 239/396 |
| 4,848,667 | 7/1989 | Dyck | 239/446 |
| 4,867,379 | 9/1989 | Hunter | 239/240 |
| 4,886,211 | 12/1989 | Cohen | 239/222.17 |
| 4,932,590 | 6/1990 | Hunter | 239/222.17 |
| 4,986,474 | 1/1991 | Schisler et al. | 239/205 |
| 5,058,806 | 10/1991 | Rupar | 239/205 |

FOREIGN PATENT DOCUMENTS 2118460A 11/1983 United Kingdom .

*Primary Examiner*—Andres Kashnikow
*Assistant Examiner*—Kevin P. Weldon
*Attorney, Agent, or Firm*—Nixon & Vanderhye

[57] ABSTRACT

A pop-up rotary sprinkler includes a sprinkler body, a rotatable distributor and nozzle assembly mounted in the sprinkler body for movement between inoperative retracted and operative extended positions in response to fluid pressure within the sprinkler body. The rotatable distributor has a plurality of water distribution grooves and is supported at an upper end portion of a shaft, while the nozzle assembly surrounds a lower end portion of the shaft. The nozzle assembly includes a discharge orifice having a peripheral surface at least a part of which is defined by a peripheral surface of the shaft, and a deflector is mounted on the shaft downstream of the discharge orifice and upstream of the distributing grooves, and is adapted to direct water emanating from the discharge orifice onto the distributing grooves so as to avoid direct impingement on a seal located at the distributor-shaft interface.

29 Claims, 5 Drawing Sheets

PART CIRCLE ROTATOR WITH IMPROVED NOZZLE ASSEMBLY

This is a continuation of application Ser. No. 07/789,690, filed Nov. 8, 1991, now abandoned.

BACKGROUND AND SUMMARY OF THE INVENTION

This invention relates to rotary sprinklers and, specifically, to pop-up rotary sprinklers of the type which include generally a sprinkler body, a discharge orifice and a rotatable distributor mounted on the sprinkler body downstream of the orifice. The orifice and distributor assemblies are typically secured to an inner stem which is movable between a retracted or inoperative position and an extended or operative position. Such sprinklers often make use of distribution grooves on the rotatable distributor which are arranged so that a stream impinging on the grooves will cause the distributor to rotate about a center axis of the sprinkler body. See, for example, U.S. Pat. Nos. 4,471,908 and 1,821,579.

It is also known to utilize in connection with such sprinklers interchangeable arc or other shaped nozzles in order to permit easy adjustment of the degree of coverage of the discharged stream, while maintaining a constant flow or precipitation rate to the watered areas. Typically, these nozzles comprise orifice plates which have a central hole for receiving a shaft which supports the distributor above the nozzle. The orifice itself is generally radially outwardly spaced from the shaft hole in the orifice plate. Representative examples of this type of construction are described in U.S. Pat. Nos. 4,932,590; 4,842,201; in the previously mentioned 4,471,908, and in 3,131,867.

It will be appreciated, however, that for a constant flow rate and constant degree of arcuate coverage, the width of the orifice necessarily decreases with radial distance from the center axis. In other words, since the arcuate length necessarily increases as the orifice is moved away from the radial center, the width of the slot necessarily must decrease to maintain constant the overall orifice area and, hence, flow rate. The narrower the orifice, however, the greater tendency for the orifice to clog with dirt or other debris. It is therefore desirable to locate the orifice as close as possible to the radial center to minimize the arcuate length and thus maximize the orifice width. This, of course, permits larger size contaminants to pass through the orifice and thereby reduces potential clogging. In the best of circumstances, therefore, the orifice slot will actually border on, or be defined partially by, the distributor supporting shaft.

There have been a few sprinkler constructions where the distributor shaft itself defines part of the nozzle discharge orifice. See U.S. Pat. Nos. 4,353,506 and 4,261,515. One significant disadvantage of having the shaft form part of the discharge orifice, however, is that the discharged stream will impinge directly on the shaft/distributor interface. In those instances where a seal is employed at that interface, the direct impingement of water on the seal can lead over time to seal damage and/or failure. Seal integrity is particularly critical in the present sprinkler assembly which includes a viscous brake within the distributor housing for slowing the rotational speed of the distributor. In this particular construction, if the distributor seal is damaged, the viscous fluid may leak out of the distributor, thereby rendering the viscous brake inoperative.

It is therefore the principal object of the present invention to take advantage of the larger discharge orifice made possible by locating the orifice directly at the center shaft while at the same time, preventing stream impingement on the distributor shaft seal.

This object is achieved by providing a deflector on the shaft immediately adjacent and downstream of the discharge orifice which directs the discharged stream away from the seal and substantially tangentially onto the stream distributing grooves of the rotatable distributor.

As mentioned above, the preferred sprinkler construction in accordance with this invention incorporates a viscous brake within the distributor. There is a need for easy yet effective filling of the viscous brake chamber and, to do this, it is necessary to permit air in the chamber to escape during filling.

It is therefore another object of the invention to provide an improved viscous brake within the distributor assembly by providing an air vent hole in the distributor housing to permit escape of air during filling of the viscous brake chamber, as well as an associated seal arrangement to prevent subsequent leakage through the vent hole.

This second object is achieved by forming a pair of radially extending holes in the distributor housing, substantially diametrically opposed to each other. One hole is used for filling the viscous brake chamber, the other for venting air as the chamber is filled. An O-ring type seal is used to close the two holes, and the seal is pressed into engagement with the holes by an adjustable distributor cap, as explained in greater detail below.

Thus, in accordance with one aspect of the invention, there is provided a rotary sprinkler having a sprinkler body, a rotatable distributor assembly and a nozzle assembly wherein the rotatable distributor assembly and nozzle assembly are axially fixed in spaced relationship with respect to each other by means of a shaft, and wherein the distributor assembly includes stream distribution surfaces, the improvement comprising a discharge orifice in the nozzle assembly at least partially defined by the shaft and a deflector on the shaft between the discharge orifice and the rotatable distributor assembly for deflecting a stream of fluid emanating from the discharge orifice onto the stream distribution surfaces.

In another aspect, the invention provides a pop-up rotary sprinkler comprising a sprinkler body, a rotatable distributor and nozzle assembly mounted in the sprinkler body for movement between inoperative retracted and operative extended positions in response to fluid pressure within said sprinkler body, said assembly including a rotatable distributor supported at an upper end portion of a shaft and a nozzle assembly surrounding a lower end portion of the shaft, the distributor having a plurality of water distributing grooves, and the nozzle assembly including a discharge orifice having a peripheral surface at least a part of which is defined by a peripheral surface of the shaft; a deflector mounted on the shaft downstream of the discharge orifice and upstream of the distributing grooves and adapted to direct water emanating from the discharge orifice to the distributing grooves.

Other objects and advantages of the present invention will become apparent from the detailed description which follows.

DETAILED DESCRIPTION OF THE DRAWINGS

Figure 1:
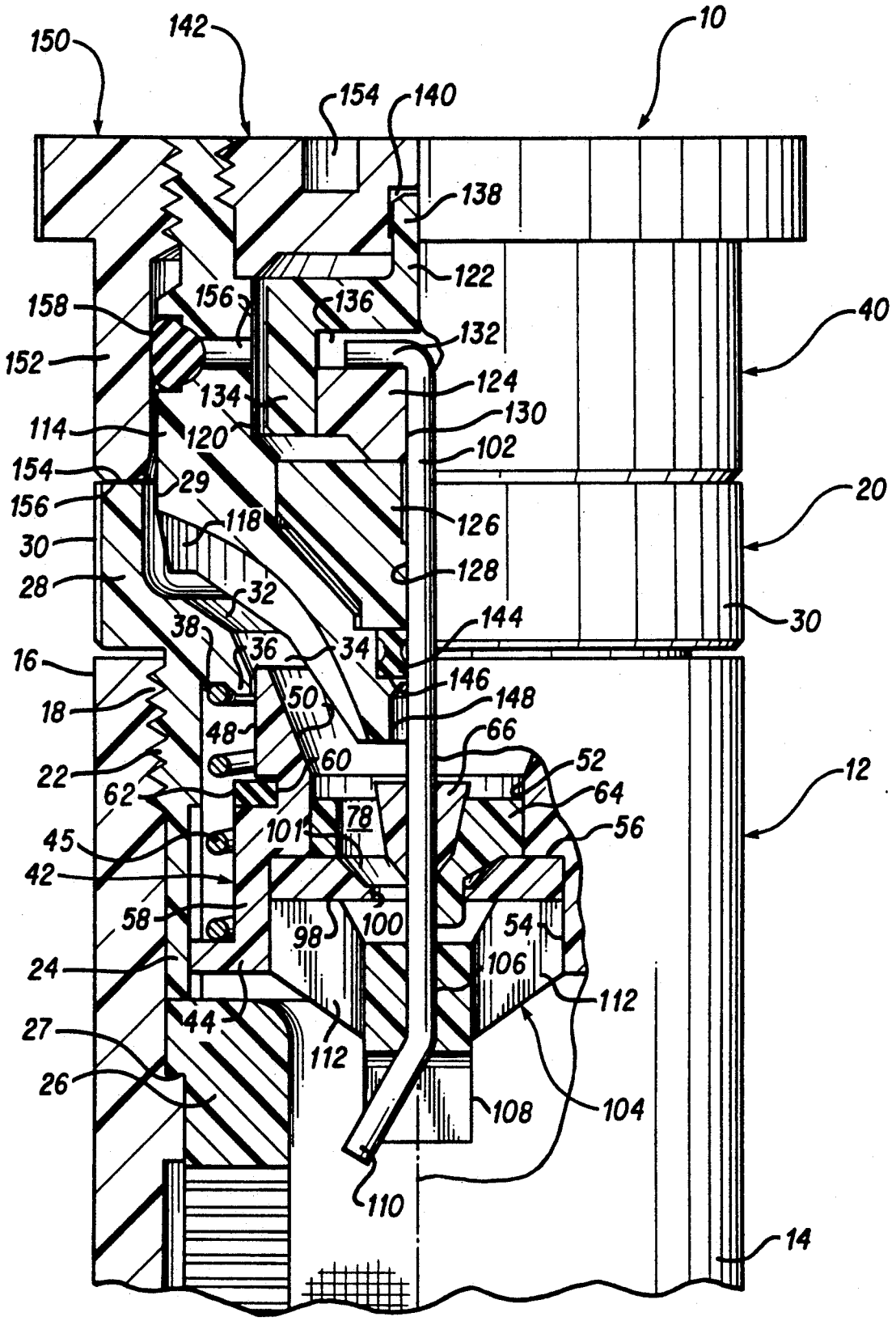
FIG. 1 is a partial cross-sectional view of a rotary pop up sprinkler in accordance with one embodiment of the invention, shown in an inoperative position.
Figure 2:
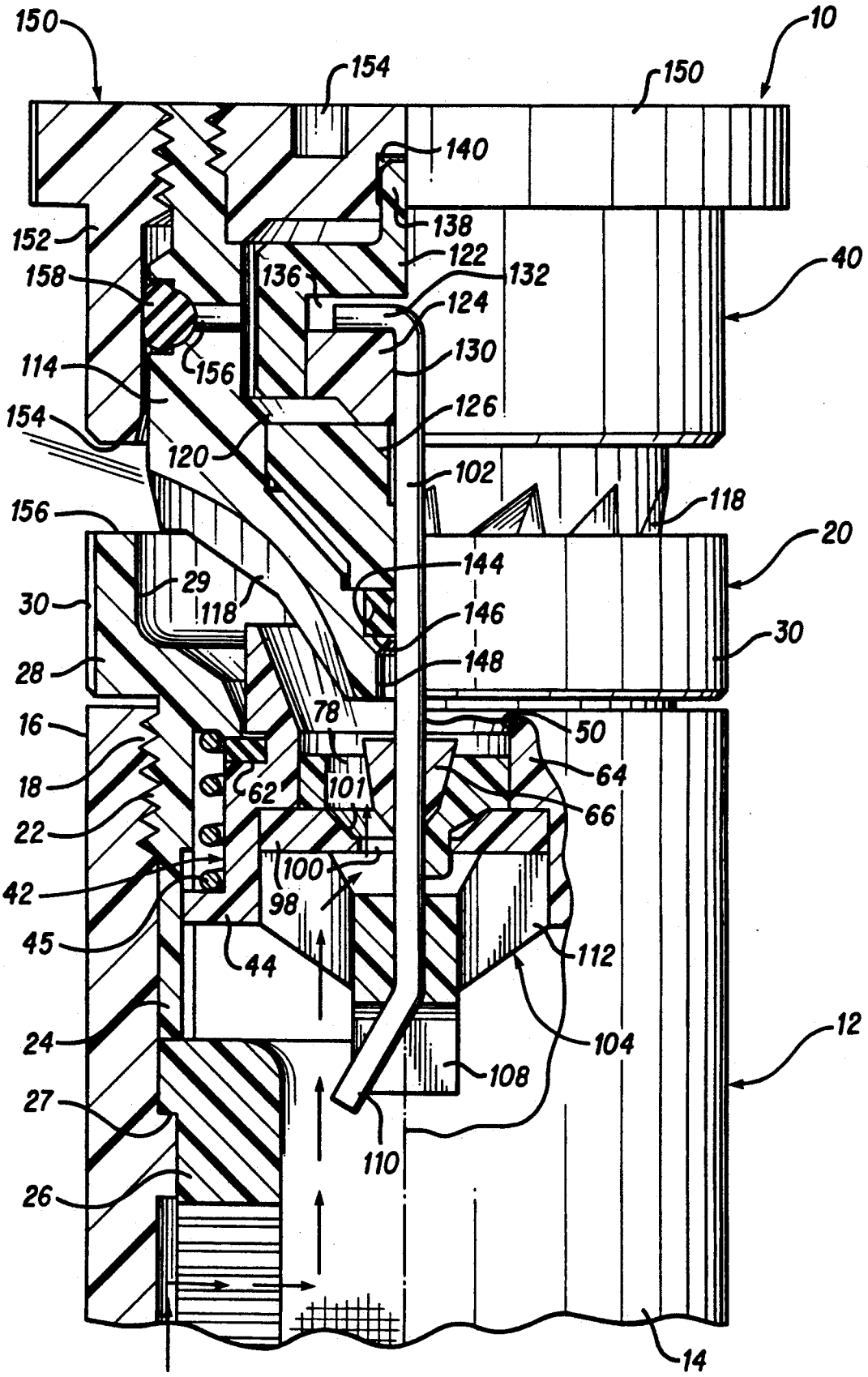
FIG. 2 is a partial cross-sectional view similar to claim 1 but with the sprinkler shown in an operative position.

Referring primarily to FIGS. 1 and 2, the sprinkler 10 includes a cylindrical main body portion 12 which may be plastic or other suitable material. The main body portion 12 has an inlet end 14 connected to a source (not shown) of water (or other liquid) under pressure. The main body portion also includes an outlet end 16, threaded on an interior surface as at 18 to receive an open tubular sleeve 20 threaded on an intermediate exterior surface as at 22. Sleeve 20 is a substantially cylindrical member, preferably plastic, and includes a lower portion 24 which engages, and holds in place, a cylindrical basket-type filter 26 through which water under pressure flows upwardly toward the outlet end 16. The basket 26 is also supported on an annular shoulder 27 provided on an interior surface of the sprinkler body portion 12. The construction of the lower portion of the sprinkler body portion 12 forms no part of this invention, and may be constructed as disclosed in commonly owned co-pending application Ser. No. 07/466,020.

Sleeve 20 also includes an upper, circumferentially enlarged portion 28, provided with a serrated exterior surface 30 to facilitate assembly and disassembly of the sleeve from the main body portion 12. Portion 28 of sleeve 20 has an interior surface 29 which merges with a radially inwardly directed, annular flange defined by inclined surfaces 32, 34 which terminate at a projection 36 which, in cooperation with an adjacent portion of sleeve 20 forms a downwardly facing annular groove 38 for a purpose to be described further below.

The sleeve 20 and its associated components described below are adapted to support a nozzle and rotary distributor assembly 40. This assembly is movable within the sprinkler main body portion 12 between a normally retracted or inoperative position (FIG. 1) and an extended or operative position (FIG. 2). The assembly 40 includes an inner stem 42 slidably received in the sleeve 20 and provided with a lower, radially outwardly extending annular flange 44. This arrangement permits a coil spring 45 to be located between the groove 38 and flange 44 so that the inner stem 42 is normally biased to the retracted, inoperative position shown in FIG. 1. The inner stem 42, which, like sleeve 20, is of open-ended tubular construction, has a reduced diameter upper end portion 48 provided with an interior outwardly tapered surface 50 which connects to a relatively small diameter inner bore 52 which, in turn, communicates with a relatively large diameter inner bore 54. An integral, horizontal shoulder 56 connects the bores 52, 54.

Figure 3:
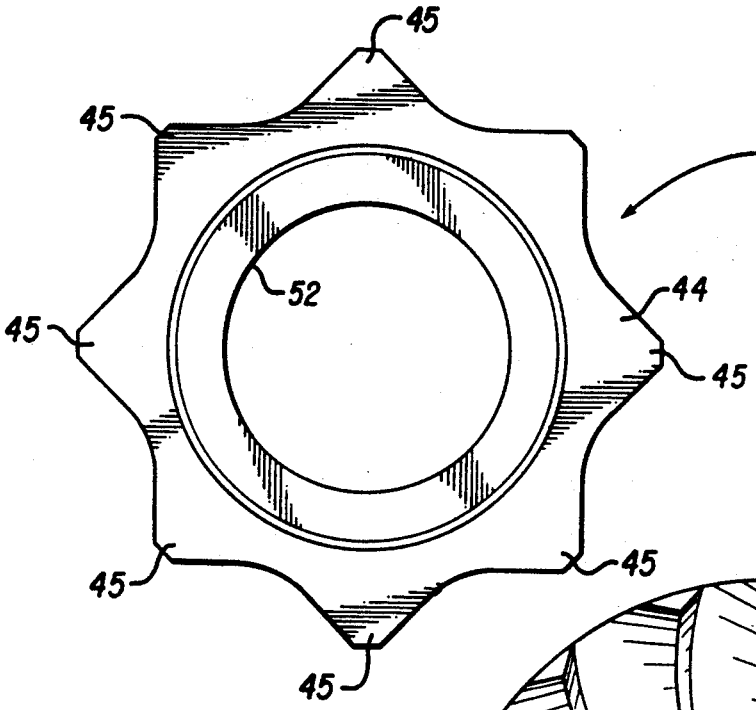
FIG. 3 is a bottom view of an inner stem component incorporated in the sprinkler shown in FIGS. 1 and 2.
Figure 5:
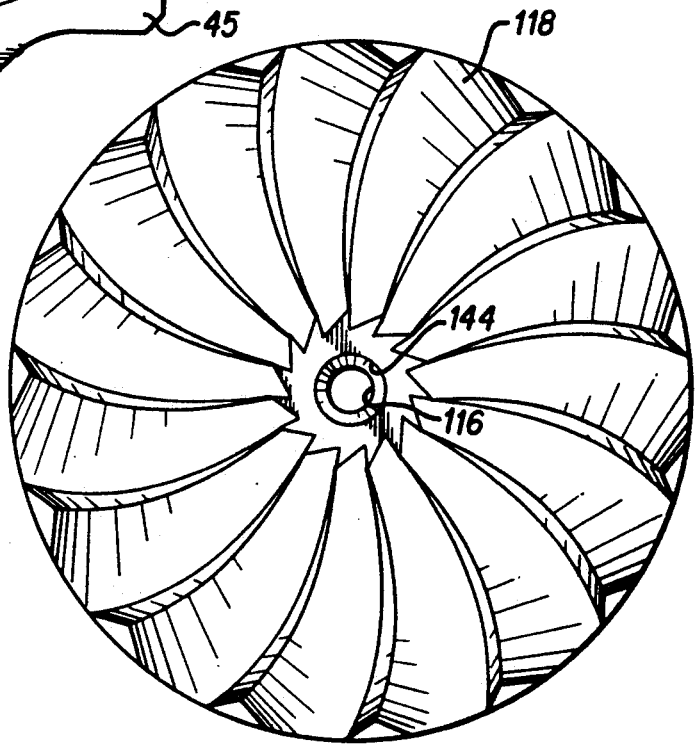
FIG. 5 is a bottom view of a rotary distributor component incorporated in the sprinkler shown in FIGS. 1 and 2.

The reduced diameter upper end portion 48 is separated from a larger diameter lower end portion 58 by an annular groove 60 which receives a resilient annular seal 62 of any suitable material, such as nitrile rubber. The lower end portion 58 of the stem 42 terminates at the previously described annular flange 44. This flange 44 has a generally circular but fluted peripheral shape as best seen in FIG. 3, with a plurality of equally spaced projections 45 extending radially outwardly from the exterior surface of the lower end portion 58.

Figure 6:
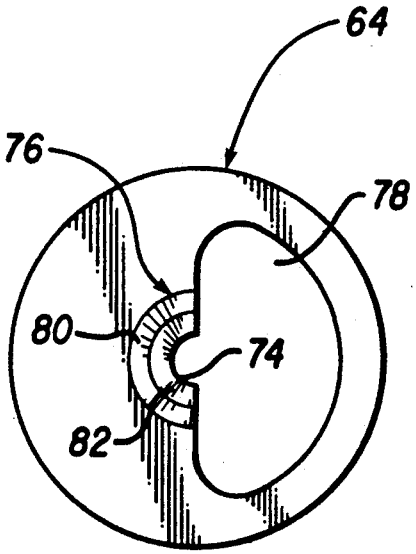
FIG. 6 is a plan view of a nozzle core component incorporated in the sprinkler shown in FIGS. 1 and 2.

The inner stem 42 receives in snug, frictional (or adhesive) engagement, a nozzle core 64 and associated cone element or deflector 66, best seen in FIGS. 1, 2, 6 and 7. Referring specifically to the latter Figures, the nozzle core 64 includes an upper, relatively larger diameter portion 68 and a lower, relatively smaller diameter portion 70, connected by a tapered surface portion 72. The interior of the core includes a central, relatively small radiused groove or semi-circular bore 74 at the lower end of the core, and a larger, conically-shaped recess 76 in axial alignment with bore 74, and located in the upper portion of the core. In addition, the upper portion of the core includes a substantially semi-circular cut-out or aperture 78 which lies to one side of the center of bore 74 (when viewed in plan, as in FIG. 6 for example). As a result of so locating the aperture 78, the tapered surfaces 80, 82 of the tapered recess 76 also extend only approximately 180°, as best seen in FIG. 6.

Figure 7:
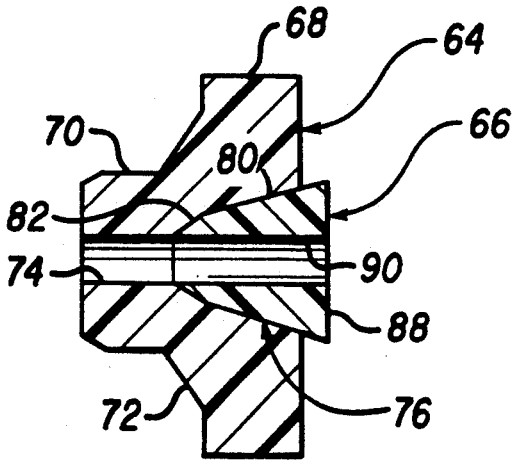
FIG. 7 is a cross-sectional view of the nozzle core component shown in FIG. 6, but with a deflector component added.
Figure 10:
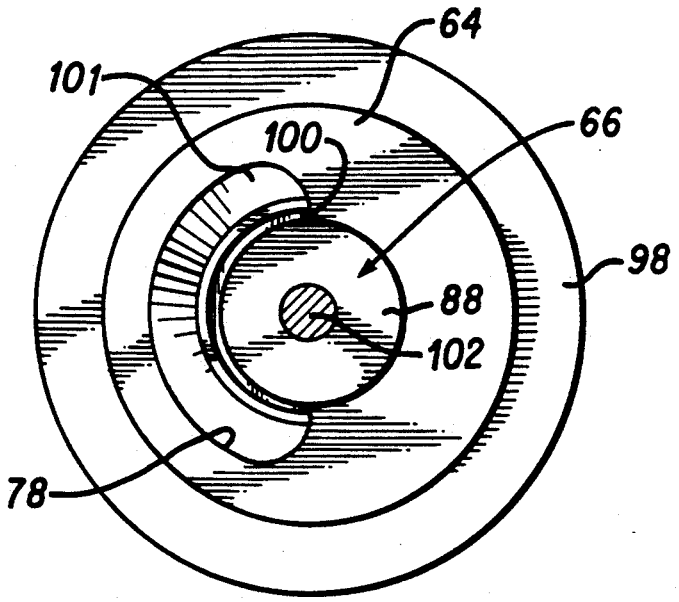
FIG. 10 is a plan view of the nozzle core component of FIG. 6, with a deflector component in place above the nozzle core, and an orifice plate in place below the nozzle core.
Figure 11:
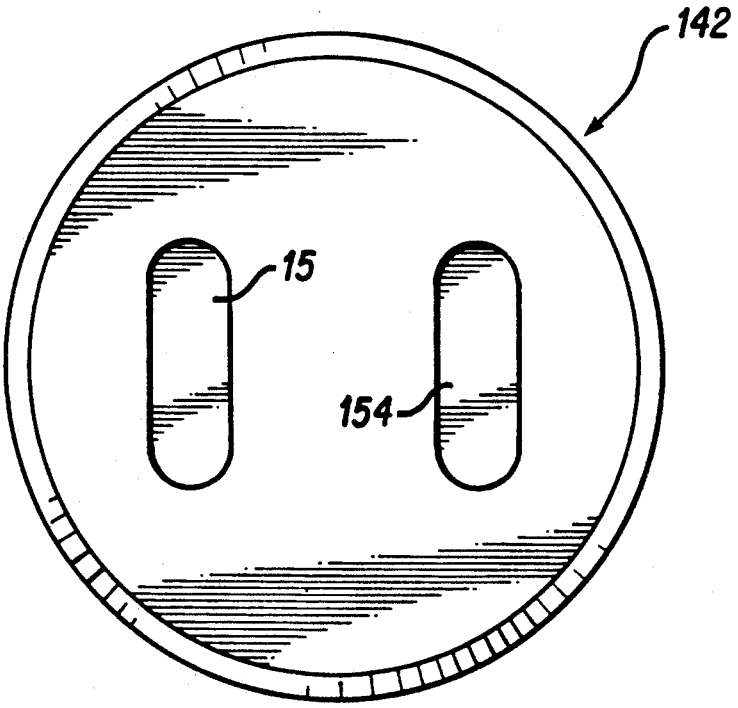
FIG. 11 is a plan view of an inner cap component incorporated in the sprinkler shown in FIGS. 1 and 2.

The deflector 66 is fitted within the recess 76 as best seen in FIGS. 7 and 10. The generally conically shaped deflector 66 includes exterior surfaces 84, 86 (FIG. 7) which are adapted to mate with tapered surfaces 80, 82 of the core 64, with a top surface 88 projecting slightly above the core. The deflector 66 is also provided with an internal axial bore 90 which is in axial alignment with the semi-circular bore 74. The deflector 66 is annular in shape, so that it projects radially into the aperture 78 as best seen in FIG. 10.

Figure 9:
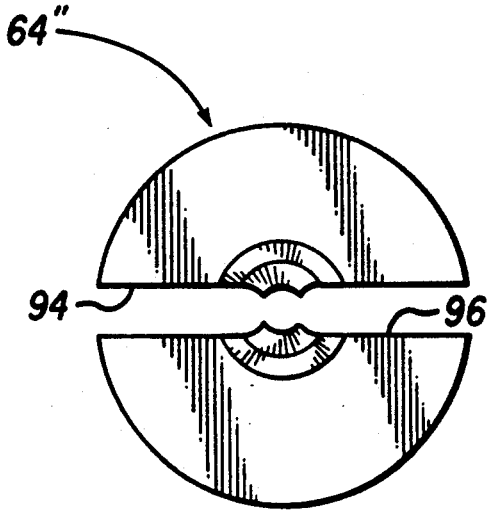
FIG. 9 is a plan view of another alternative nozzle core component for use with the invention.
Figure 8:
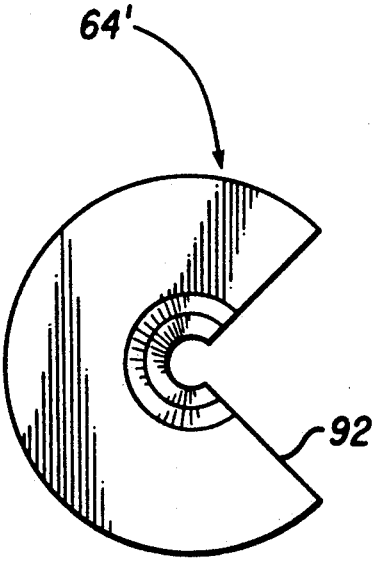
FIG. 8 is a plan view of an alternative nozzle core component for use with the invention.

The configuration of the nozzle core as shown in FIG. 6 is only one of several possible designs, depending on the degree of arcuate coverage desired for the sprinkler. A narrower arcuate extent would be obtained, for example, by utilization of the core component 64′ shown in FIG. 8, where the nozzle orifice or cut-out 92 extends only about 90°. In FIG. 9, still another embodiment is illustrated where the core component 64″ is split along cut-out surfaces 94, 96. In this case, the conical deflector 66 may be glued in place between the split components and defining a pair of diametrically opposed nozzle orifices.

It will be further appreciated that the nozzle core 64 and deflector 66 may be constructed as a unitary, molded component in the desired shape.

With reference now to FIGS. 1, 2 and 10, an orifice plate 98 is fitted within the larger diameter bore 54 of the stem 42, in abutting relationship with the underside of the nozzle core 64. The orifice plate includes a circular opening 100 at the base of a tapered counter bore 101 and which receives the lower portion 70 of the nozzle core 64. In fact, the lower portion 70 of the nozzle core projects completely through the orifice 100. At the same time, the deflector 66, received in the nozzle core as described above, also projects into the orifice plate 98 to approximately the depth of the counterbore 101.

A shaft 102 (preferably 302 Stainless spring wire) extends through aligned bores 74, 90 as best seen in FIGS. 1 and 7. As will be appreciated from FIGS. 1, 2 and 10, the discharge orifice for water under pressure is formed by a portion of discharge opening 100, the shaft 102 and the nozzle aperture 78 in the core 64. By locating the discharge orifice radially inwardly at the center axis of the sprinkler, to the point where shaft 102 actually forms a part of the discharge orifice, the arcuate length of the orifice may be shortened and its width increased. In an exemplary embodiment, the widened orifice will pass particles with a 0.040" diameter while achieving a flow rate of about 0.3 gpm.

It is to be understood that the deflector 66 may be utilized alone in combination with the orifice plate 98, i.e., the nozzle core 64 may be omitted so as to provide a full circle sprinkling pattern. Where no core component 64 is utilized, the deflector 66 may be bonded directly to the shaft 102. Where a core and deflector are utilized, they may be formed as an integral, molded unit. It will be further understood that the orifice plate itself may be modified to have an aperture of other than circular shape, e.g., rectangular, square, triangular, etc. but in all cases the orifice will surround the shaft 102.

The shaft 102 is supported at its lower end within a spider element 104 which includes a central body portion provided with a central bore 106 adapted to receive the shaft 102. The lower portion 108 of the spider is bifurcated to thereby enable the lower end 110 of the shaft 102 to be bent relative to the remaining axially extending portion of the shaft to insure against axial and rotational movement of the shaft 102 relative to the stem 42 and spider 104.

Figure 4:
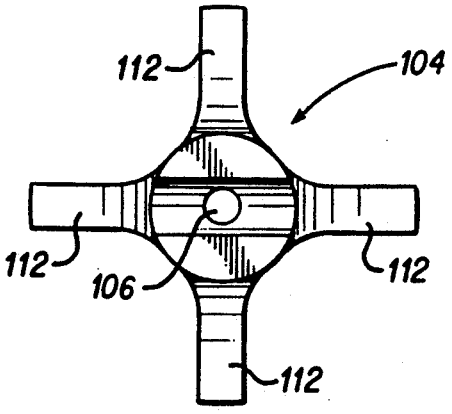
FIG. 4 is a bottom view of a spider component incorporated in the sprinkler shown in FIGS. 1 and 2.

With additional reference to FIG. 4, the upper portion of the spider 104 is formed with a plurality (preferably four) upwardly and outwardly extending radial spokes 112 which are press fit or glued within the larger diameter portion 54 of the stem 42, underlying the orifice plate 98.

The above described nozzle assembly components, i.e., inner stem 42, nozzle core 64, deflector 66, orifice plate 98 and spider 104 are constructed of any suitable material, preferably polycarbonate rod.

The upper half of the shaft 102 extends upwardly, away from the nozzle core 64 and deflector cone 66 to support thereon the rotary distributor assembly 40.

More specifically, the distributor assembly 40 includes a distributor housing 114 (which may also be formed of polycarbonate rod material) including a lower portion which is provided with a circular aperture 116 through which shaft 102 extends. The lower portion of housing 114 is also provided on its periphery with a plurality of water distributing grooves 118 downwardly and inwardly directed relative to the center axis of the sprinkler, as defined by the shaft 102. As is conventional, the water distributing grooves 118 are slightly curved in a circumferential sense so that impingement of the stream discharged from orifice 100 will cause rotation of the distributor housing 114 as explained further below.

The housing 114 has a substantially hollow interior defining a viscous brake chamber 120. Within the chamber there is a stator assembly including upper and lower stator components 122 and 124 (preferably acetal rod material), and an associated bearing 126, respectively. The bearing component 126 (preferably constructed of Teflon ®) has a generally conical shape and is provided with a central bore 128 for receiving the upper end portion of the shaft 102. The lower stator component 124 also has a central bore 130 which receives an adjacent upper portion of the shaft. An upper free end portion 132 of the shaft 102 may be bent as also shown in FIGS. 1 and 2 to aid in preventing axial movement of the shaft 102 relative to the distributor assembly in general. The lower stator component 124 may be bonded to the shaft 102, so as to remain stationary relative to the rotatable distributor housing 114.

The upper stator component 122 has a generally inverted cup shape with an annular skirt 134 defining a hollow interior portion 136 which receives the lower stator component 124 and which overlies the bent portion 132 of shaft 102. The exterior of upper stator component 122 includes a boss 138 which is received within a recess 140 formed in an inner distributor assembly cap 142. The boss 138 and recess 140 may be shaped to permit rotation of the housing 114 relative to the stator component 122.

The viscous brake chamber is sealed at its lower end by an annular seal 144 which is seated on an internal shoulder 146 (which defines the aperture 116) and which snugly engages the shaft 102. The lower end of the housing 114 is also provided with a counter bore 148 immediately below the seal 144 in surrounding but radially spaced relationship relative to the shaft.

The distributor housing 114 is threaded on both inner and outer surfaces at its upper end. The inner threads are provided to threadably receive the inner cap 142 while the exterior threads are provided to threadably receive an outer cap 150. The outer cap has an annular depending skirt 152, the bottom surface 154 of which is adapted to engage the upper edge surface 156 of the sleeve component 20 when the sprinkler is in the retracted, inoperative position. This arrangement prevents any debris from settling in the nozzle area while the sprinkler is not in use.

With reference to FIG. 2, it will be seen that when outer cap 150 is substantially flush with the inner cap 142, and when the distributor assembly is in the extended or operative position, the annular skirt 152 allows unrestricted distribution of the discharged stream from the distribution grooves 118. The outer cap 150 may, however, be rotated to lower the depending skirt 152 at least partially into the stream to thereby further deflect the stream if so desired.

The inner cap 142 is provided with one or more tool engagement slots 154 for facilitating removal of the inner cap to gain access to the viscous brake chamber 120. The latter is at least partially but preferably completely filled with viscous fluid in order to create a viscous shearing of the fluid between the closely spaced stator components and distributor housing wall in a manner similar to that disclosed in commonly owned U.S. Pat. No. 4,660,766.

In order to permit air to escape from the distributor chamber 120 during filling, a pair of holes 156 (one shown) are provided which extend horizontally and radially outwardly through the housing wall, at location diametrically opposed to each other. In this way, one hole can be used for filling the chamber while the other is used to vent air from the chamber during filling. Upon completion of the filling operation, the vent holes are closed by an O-ring or similar seal 158, which is pressed into sealing engagement with the vent holes 156 by annular depending skirt 152 as best seen in FIGS. 1 and 2. It will be appreciated that other vent/seal arrangements may be used. For example, holes 156 could be surrounded by a raised ring engageable by the skirt 152.

In use, upon introduction of water under pressure into the inlet end 14 of the main body portion 12, with subsequent flow of water through the main body portion 12 and cylindrical basket-type filter 26, as indicated by the flow arrows in FIG. 2, the inner stem 42 will be forced upwardly to an extended or operative position, thereby allowing the water to be discharged from the sprinkler in the intended manner. The water will flow through the filter basket 26, between the spokes 112 of spider component 104, and through the orifice 100 and core aperture 78. At the same time, and prior to full extension of the inner stem 42, water will also flow from basket 26 through the spaces between projections 45 formed in the flange 44 and between the annular space between inner stem 42 and projection 36 of the sleeve 20. This initial bypass flow clears any debris which may be present between the sleeve 20 and distribution grooves 18. It will be appreciated that this is a relatively short burst which will terminate when seal 62 engages the projection 36.

Immediately upon discharge through the aperture 78, the water will impinge upon the deflector 66 which directs the water away from the distributor seal 144 and onto the distribution grooves 118. Impingement of the water stream on the distribution grooves 118 causes the distributor housing to rotate about the fixed shaft 102 and relative to the fixed stator components 122 and 124. The relative movement between the distributor housing and stator components is slowed by the shearing action of the viscous fluid within the viscous brake chamber 120. As previously indicated, selection of a particular core component 64 (or the omission of core component 64) and a particular orifice plate 98, the shape and degree of arcuate coverage of the sprinkling pattern can be controlled. In addition, the outer distributor cap 150 may be rotated downwardly into engagement with the stream to further deflect the stream as desired. It will be appreciated, of course, that the significant features of the invention are equally applicable to non-pop-up type rotary sprinklers as well.

Various modifications of the above described sprinkler construction are within the scope of the invention. In addition to the various configurations discussed hereinabove concerning the orifice plate and nozzle core, it will be appreciated that the stator components 122 and 124 may be integrally formed as a single unit. Similarly, for those instances where a single use sprinkler is desired, the inner stem 42, nozzle core 64, deflector 66 and orifice plate 98 may also be molded as an integral unit.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is

1. A pop-up rotary sprinkler comprising a sprinkler body, a rotatable distributor and a non-rotatable nozzle assembly mounted in said sprinkler body for movement relative to said sprinkler body between inoperative retracted and operative extended positions in response to fluid pressure within said sprinkler body, said assembly including a rotatable distributor supported at an upper end portion of a shaft and a non-rotatable nozzle assembly surrounding a lower end portion of the shaft in axially spaced relationship to said rotatable distributor, with said nozzle assembly, arranged to discharge a stream to atmosphere; said rotatable distributor having a plurality of water distributing grooves arranged to receive the stream and to redirect the stream in a sprinkling pattern; said nozzle assembly including a discharge orifice having a peripheral surface at least a part of which is defined by a peripheral surface of said shaft; and a deflector mounted on said shaft downstream of said discharge orifice and upstream of said rotatable distributor and arranged to direct water emanating from said discharge orifice away from said shaft onto said distributing grooves.

2. The pop-up sprinkler of claim 1 wherein said rotatable distributor and nozzle assembly is normally spring biased to said inoperative position.

3. The pop-up sprinkler of claim 1 wherein said nozzle assembly includes a tubular inner stem in which is secured an orifice plate containing said discharge orifice.

4. The pop-up sprinkler of claim 3 wherein said inner stem has first and second inner diameter portions connected by a shoulder, said orifice plate seated on said shoulder.

5. The pop-up sprinkler of claim 3 wherein the inner stem includes an outwardly flared inner surface downstream of said orifice plate, said outwardly flared surface lying at least partially adjacent said distributing grooves.

6. The pop-up sprinkler of claim 4 wherein the inner stem includes an outwardly flared inner surface downstream of said orifice plate, said outwardly flared surface lying at least partially adjacent said distributing grooves.

7. The pop-up sprinkler of claim 3 and including a sleeve component having upper and lower ends, said sleeve component threadably received in an outlet end of the sprinkler body, said sleeve component adapted to receive said inner stem in sliding relationship therewith, said sleeve component having a radially inwardly directed flange intermediate said upper and lower ends thereof; said inner stem having a radially outwardly directed flange at a lower end thereof; and a coil spring surrounding said inner stem and extending axially between said radially inwardly directed flange and said radially outwardly directed flange.

8. The pop-up sprinkler of claim 7 and wherein said inner stem is provided with an external annular seal adapted to engage said radially inwardly directed flange when said distributor and nozzle assembly is in said extended operative position.

9. The pop-up sprinkler of claim 3 and including a nozzle core surrounding said deflector and seated on said orifice plate.

10. The pop-up sprinkler of claim 9 wherein said nozzle core and deflector are integrally formed.

11. The pop-up sprinkler of claim 3 and further including a spider element receiving the lower end of said shaft, said spider element including radially extending legs, top surfaces of said legs engaging a lower surface of said orifice plate.

12. The pop-up sprinkler of claim 1 wherein said rotatable distributor is provided with a substantially hollow interior defining a viscous brake chamber; wherein said upper end portion of said shaft mounts, and is received in, at least one stator component and at least one bearing located in said viscous brake chamber; and further wherein said viscous brake chamber contains a viscous fluid.

13. The pop-up sprinkler of claim 12 wherein said distributor has a cap threadably secured thereto, said cap having a depending skirt adjustable to divert a stream of fluid exiting from said distributing grooves.

14. The pop-up sprinkler of claim 13 wherein said distributor is provided with a through-hole for introducing said viscous fluid into said viscous brake chamber, and a resilient seal covering said through-hole; and wherein said depending skirt presses said seal into sealing engagement with said through-hole.

15. In a rotary sprinkler having a sprinkler body, a non-rotatable nozzle assembly arranged to discharge a stream to atmosphere, and a rotatable distributor assembly, wherein the rotatable distributor assembly and the non-rotatable nozzle assembly and the non-rotatable nozzle assembly are axially fixed in spaced relationship with respect to each other by means of a non-rotatable shaft, and wherein said distributor assembly includes stream distribution surfaces arranged to receive the stream downstream from said nozzle assembly, the improvement comprising a discharge orifice in said non-rotatable nozzle assembly at least partially defined by said non-rotatable shaft, and a deflector on said non-rotatable shaft between said discharge orifice and said rotatable distributor assembly for deflecting the stream emanating from said discharge orifice away from an interface of said non-rotatable shaft and said rotatable distributor and onto said stream distribution surfaces.

16. The rotary sprinkler of claim 15 wherein said discharge orifice has a part-circle shape.

17. The rotary sprinkler of claim 15 wherein said deflector is received within a recess formed in a nozzle core component, the nozzle core component having an aperture overlying an orifice plate.

18. The rotary sprinkler of claim 17 wherein the aperture in the nozzle core component is semi-circular in shape.

19. The rotary sprinkler of claim 17 wherein the aperture in the nozzle core component has a quarter circle shape.

20. The rotary sprinkler of claim 15 wherein the rotatable distributor assembly and nozzle assembly are movable relative to the sprinkler body between retracted and extended positions.

21. The rotary sprinkler of claim 20 and including means for establishing a temporary bypass flow around said nozzle assembly.

22. The rotary sprinkler of claim 20 and including means for establishing a water tight seal between the nozzle assembly and sprinkler body when the distributor assembly and nozzle assembly are in the extended position.

23. The rotary sprinkler of claim 15 wherein the distributor assembly incorporates a viscous brake.

24. A rotary sprinkler including a sprinkler body having an outlet end, a discharge nozzle assembly located within said outlet end and including a discharge orifice; a rotatable distributor assembly supported above said discharge nozzle assembly, the distributor assembly including a viscous brake for inhibiting rotation of the distributor assembly caused by impingement of a stream issuing from the discharge orifice; a non-rotatable shaft extending between the discharge nozzle assembly and the distributor assembly, said shaft extending through said discharge orifice and into the distributor assembly; a seal interposed radially between the shaft and the distributor assembly; and means for deflecting the stream issuing from said discharge orifice away from said seal.

25. The rotary sprinkler of claim 24 wherein said distributor assembly includes a plurality of distribution grooves, and said deflecting means deflects the stream substantially tangentially onto said distribution grooves.

26. The rotary sprinkler of claim 24 wherein said discharge nozzle assembly includes an orifice plate having an orifice therein, and said deflecting means comprises a substantially conical component mounted on said shaft immediately downstream of said orifice.

27. The rotary sprinkler of claim 24 wherein said shaft is rotationally stationary, and a bearing is mounted on said shaft within said distributor assembly.

28. The rotary sprinkler of claim 24 wherein said distributor assembly is provided with at least one stator component mounted on said shaft.

29. A pop-up rotary sprinkler comprising a sprinkler body, a rotatable distributor and nozzle assembly mounted in said sprinkler body for movement between inoperative retracted and operative extended positions in response to fluid pressure within said sprinkler body, said assembly including a rotatable distributor supported at an upper end portion of a stationary shaft and a nozzle assembly surrounding a lower end portion of the shaft, said distributor having a plurality of water distributing grooves, and said nozzle assembly including a discharge orifice having a peripheral surface at least a part of which is defined by a peripheral surface of said shaft; a seal radially between said shaft and distributor at an end of the distributor proximate to the discharge orifice; and a deflector mounted on said shaft downstream of said discharge orifice and upstream of said distributing grooves and adapted to direct water emanating from said discharge orifice away from said shaft to said distributing grooves.

* * * * *